US011236581B2

(12) United States Patent
al-Shammari

(10) Patent No.: US 11,236,581 B2
(45) Date of Patent: Feb. 1, 2022

(54) CURING A LOST CIRCULATION ZONE IN A WELLBORE

(71) Applicant: Saudi Arabian Oil Company, Dhahran (SA)

(72) Inventor: Saad S. al-Shammari, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/031,103

(22) Filed: Sep. 24, 2020

(65) Prior Publication Data

US 2021/0002974 A1 Jan. 7, 2021

Related U.S. Application Data

(62) Division of application No. 15/896,367, filed on Feb. 14, 2018, now Pat. No. 10,822,916.

(51) Int. Cl.

| | |
|---|---|
| ***E21B 33/138*** | (2006.01) |
| ***E21B 33/134*** | (2006.01) |
| ***E21B 33/127*** | (2006.01) |
| ***E21B 21/00*** | (2006.01) |

(52) U.S. Cl.

CPC ..... *E21B 33/138* (2013.01); *E21B 21/003* (2013.01); *E21B 33/1277* (2013.01); *E21B 33/134* (2013.01)

(58) Field of Classification Search

CPC ..... E21B 33/13; E21B 33/138; E21B 21/003; E21B 33/1277; E21B 33/134

See application file for complete search history.

(56) References Cited

U.S. PATENT DOCUMENTS

| | | | |
|---|---|---|---|
| 4,498,995 | A | 2/1985 | Gockel |
| 4,584,327 | A | 4/1986 | Sutton |
| 4,643,255 | A | 2/1987 | Sandiford et al. |
| 4,935,060 | A | 6/1990 | Dingsoyr |
| 5,030,366 | A | 7/1991 | Wilson et al. |

(Continued)

FOREIGN PATENT DOCUMENTS

| | | | |
|---|---|---|---|
| CN | 101 718 183 | A | 6/2010 |
| CN | 106 948 789 | A | 7/2017 |

(Continued)

OTHER PUBLICATIONS

Datwani, A., Review of Lost Circulation Mechanisms with the Focus On Loss to Natural and Drilling Induced Fractures, Dalhousie University, Halifax, Nova Scotia, 92 pages (Jul. 2012).

(Continued)

*Primary Examiner* — Crystal J. Lee

(74) *Attorney, Agent, or Firm* — Choate, Hall & Stewart LLP; Charles E. Lyon; Peter A. Flynn

(57) ABSTRACT

An example method of forming a well includes identifying a lost circulation zone in a wellbore, where the lost circulation zone includes a fracture in a formation adjacent to the wellbore; arranging an inflatable in a vicinity of the lost circulation zone; forcing slurry into the inflatable to cause at least part of the inflatable containing the slurry to expand into the fracture; allowing the slurry to set for a period of time to produce a solid; and drilling through the solid in the inflatable in the wellbore, leaving the solid in the fracture.

10 Claims, 5 Drawing Sheets

(56) References Cited

U.S. PATENT DOCUMENTS

| | | | |
|---|---|---|---|
| 5,086,841 | A | 2/1992 | Reid et al. |
| 5,297,633 | A | 3/1994 | Snider et al. |
| 5,325,921 | A | 7/1994 | Johnson et al. |
| 5,402,849 | A | 4/1995 | Jennings, Jr. |
| 5,458,194 | A | 10/1995 | Brooks |
| 5,789,352 | A | 8/1998 | Carpenter et al. |
| 6,548,452 | B1 | 4/2003 | Nattier et al. |
| 6,742,592 | B1 | 6/2004 | Le Roy-Delage et al. |
| 6,765,153 | B2 | 7/2004 | Goodson |
| 6,790,812 | B2 | 9/2004 | Halliday et al. |
| 7,219,732 | B2 | 5/2007 | Reddy |
| 7,740,070 | B2 | 6/2010 | Santra et al. |
| 7,964,413 | B2 | 6/2011 | Macioszek et al. |
| 8,820,405 | B2 | 9/2014 | Turner et al. |
| 9,062,241 | B2 | 6/2015 | Zamora et al. |
| 10,822,916 | B2 | 11/2020 | Al-Shammari |
| 2006/0272819 | A1 | 12/2006 | Santra et al. |
| 2007/0017676 | A1 | 1/2007 | Reddy et al. |
| 2008/0023200 | A1 | 1/2008 | Reddy et al. |
| 2008/0196628 | A1 | 8/2008 | Santra et al. |
| 2009/0178809 | A1 | 7/2009 | Jeffryes et al. |
| 2009/0183875 | A1 | 7/2009 | Rayssiguier et al. |
| 2009/0186781 | A1 | 7/2009 | Zhang |
| 2009/0192052 | A1 | 7/2009 | Zhang |
| 2009/0308611 | A1 | 12/2009 | Santra et al. |
| 2009/0312203 | A1 | 12/2009 | Huang |
| 2010/0252276 | A1 | 10/2010 | Clausen et al. |
| 2014/0305662 | A1 | 10/2014 | Giroux et al. |
| 2015/0267501 | A1 | 9/2015 | Al-Gouhi |
| 2016/0251938 | A1 | 9/2016 | Murray et al. |
| 2019/0249515 | A1 | 8/2019 | al-Shammari |

FOREIGN PATENT DOCUMENTS

| | | | | | |
|---|---|---|---|---|---|
| CN | 106948789 | A | * | 7/2017 | ..... E21B 23/03 |
| WO | WO-9927032 | A1 | | 6/1999 | |
| WO | WO-03/042494 | A1 | | 5/2003 | |
| WO | WO-03042494 | A1 | * | 5/2003 | ..... E21B 33/134 |
| WO | WO-2004057150 | A1 | | 7/2004 | |
| WO | WO-2012143687 | A1 | | 10/2012 | |
| WO | WO-2014055402 | A1 | | 4/2014 | |
| WO | WO-2014120458 | A1 | | 8/2014 | |
| WO | WO-2017034637 | A1 | | 3/2017 | |
| WO | WO-2019/158985 | A1 | | 8/2019 | |

OTHER PUBLICATIONS

Finger, J. T. and Livesay, B., Alternative Wellbore Lining Methods: Problems and Possibilities, Sand Report, Sandia National Laboratories, 35 pages (printed Aug. 2002).

International Search Report for PCT/IB2018/056517, 5 pages (dated Dec. 13, 2018).

Written Opinion for PCT/IB2018/056517, 8 pages (dated Dec. 13, 2018).

Written Opinion of the International Preliminary Examining Authority for PCT/IB2018/056517, 16 pages (dated Feb. 17, 2020).

* cited by examiner

CURING A LOST CIRCULATION ZONE IN A WELLBORE

RELATED APPLICATIONS

The present application is a Divisional Application of U.S. patent application Ser. No. 15/896,367, filed on Feb. 14, 2018, titled "Curing a Lost Circulation Zone in a Wellbore" (now U.S. Pat. No. 10,822,916), the entire contents of which are hereby incorporated by reference in their entirety.

TECHNICAL FIELD

This specification relates generally to example processes for curing a lost circulation zone in a wellbore.

BACKGROUND

In a well, such as an oil well, a lost circulation zone is a region in a subterranean formation that inhibits, or prevents, return of mud or other materials following introduction of drilling fluid. For example, during creation and completion of a well, drilling fluid is introduced into the wellbore. Then, mud and other materials from the wellbore flow back to the surface of the well. However, in a lost circulation zone, the introduction of drilling fluid into the wellbore does not produce a corresponding flow back to the surface of the well.

There can be various causes for lost circulation zones. In some cases, the formation may be highly permeable and have a less-than-normal hydrostatic pressure. In some cases, the formation may contain faults, such as fractures, into which the drilling fluid escapes, thereby interrupting the circulation of fluids into, and out of, the wellbore. Such faults in the formation can also adversely affect cementing operations performed to complete the well. For example, fluids in the formation can prevent, or prolong, hardening of cement slurry. This may be due, at least in part, to mixing of the fluids with the cement slurry. For example, this mixing of fluids may prevent the slurry from ever setting enough to harden.

In some situations, lost circulation material (LCM) pills, cement plugs, and X-linked polymer plugs have been injected into a lost circulation zone in a well in attempts to cure the lost circulation zones.

SUMMARY

An example method of forming a well includes identifying a lost circulation zone in a wellbore, where the lost circulation zone includes a fracture in a formation adjacent to the wellbore; arranging an inflatable in a vicinity of the lost circulation zone; forcing slurry into the inflatable to cause at least part of the inflatable containing the slurry to expand into the fracture; allowing the slurry to set for a period of time to produce a solid; and drilling through the solid in the inflatable in the wellbore, leaving the solid in the fracture. The example method may include one or more of the following features, either alone or in combination.

The drilling may include introducing drilling fluid into the wellbore. The slurry in the fracture may be set for a period of time to produce the solid in the fracture that isolates the fracture from the drilling fluid. The wellbore may include a conduit having a joint that is in the vicinity of the lost circulation zone. Arranging the inflatable may include mounting the inflatable to the joint. The conduit may be removed from the wellbore prior to drilling.

The example method may include arranging a circulating sub uphole of the joint. The circulating sub may operate to displace drilling fluid prior to forcing the slurry into the inflatable. Operation of the circulating sub may be discontinued based on the slurry reaching a circulating valve in the circulating sub. Forcing the slurry into the inflatable may include using one or more pumps to pump the slurry into the inflatable until the inflatable reaches a predefined expansion without breaking.

The slurry may be or include cement slurry, and the solid may be or include cement. The slurry may be or include gunk plug, and the solid may be or include a substance formed from the gunk plug. The slurry may be or include a resin-based substance. The inflatable may be or include a balloon. The conduit may be or include a drill pipe. The conduit may include fiberglass.

The fracture may contain formation fluid. The part of the inflatable enters the formation and forces at least part of the formation fluid from a region adjacent to the wellbore. Following setting, the inflatable confines the formation fluid within the fracture.

An example system includes a conduit in a wellbore. The conduit includes a joint located in a vicinity of at least part of a lost circulation zone in the wellbore. The lost circulation zone includes a fracture in a formation adjacent to the wellbore. The system also includes an inflatable mounted to the joint, and one or more pumps to force slurry through the conduit and into the inflatable to cause at least part of the inflatable containing the slurry to expand into the fracture. The slurry has a composition to produce, upon setting, a solid in both the wellbore and the fracture. The example system may include one or more of the following features, either alone or in combination.

The example system may include a drill that is controllable to cut through the solid in the inflatable in the wellbore following setting of the slurry. The example system may include a circulating sub uphole of the joint. The circulating sub may be configured to displace drilling fluid at least prior to forcing the slurry into the inflatable. The circulating sub may be configured to discontinue operation in response to the slurry reaching a valve in the circulating sub. The one or more pumps may be controllable to force the slurry into the inflatable until the inflatable reaches a predefined expansion without breaking.

The slurry may be or include cement slurry, and the solid may be or include cement. The slurry may be or include gunk plug, and the solid may be or include a substance formed from the gunk plug. The slurry may be or include a resin-based substance. The inflatable may be or include a balloon. The conduit may be or include a drill pipe. The conduit may include fiberglass.

The fracture may contain formation fluid. The one or more pumps may be controllable to force the slurry into the inflatable such that the part of the inflatable that enters the formation forces at least part of the formation fluid from a region adjacent to the wellbore. Following setting, the inflatable confines the formation fluid within the fracture.

Any two or more of the features described in this specification, including in this summary section, may be combined to form implementations not specifically described in this specification.

All or part of the processes, methods, systems, and techniques described in this specification may be controlled by executing, on one or more processing devices, instructions that are stored on one or more non-transitory machine-readable storage media. Examples of non-transitory machine-readable storage media include read-only memory, an optical disk drive, memory disk drive, random access memory, and the like. All or part of the processes, methods, systems, and techniques described in this specification may be controlled using a computing system comprised of one or more processing devices and memory storing instructions that are executable by the one or more processing devices to perform various control operations.

The details of one or more implementations are set forth in the accompanying drawings and the description subsequently. Other features and advantages will be apparent from the description and drawings, and from the claims.

DESCRIPTION OF THE DRAWINGS

Like reference numerals in different figures indicate like elements.

DETAILED DESCRIPTION

Described in this specification are example processes for curing a lost circulation zone in a wellbore. The example processes include detecting a lost circulation zone in a wellbore. A lost circulation zone may include a part of the wellbore that traverses a rock formation containing faults, such as fractures, into which drilling fluid escapes, thereby interrupting the circulation of fluids into, and out of, the wellbore. An inflatable, such as a balloon, is arranged in the vicinity of the lost circulation zone. For example, the inflatable may be arranged within or uphole of the lost circulation zone. The inflatable may be connected to a joint or other appropriate structure in a conduit introduced into the wellbore. Slurry, such as cement slurry, is forced into the inflatable to cause its expansion. As the inflatable expands, one or more parts of the inflatable containing the slurry expand into fractures in the formation. In some implementations, the inflatable is configured and arranged to enable expansion throughout the lost circulation zone. As a result, all or some faults in the lost circulation zone are wholly or partly filled with slurry contained within the inflatable. The slurry is then set for a period of time to produce a solid, such as cement, which is present both in the wellbore and in the formation fractures. A drill then cuts through the solid in the wellbore, leaving the solid in the fractures. The solid thus fills the fractures, thereby curing the lost circulation zone.

Figure 1:
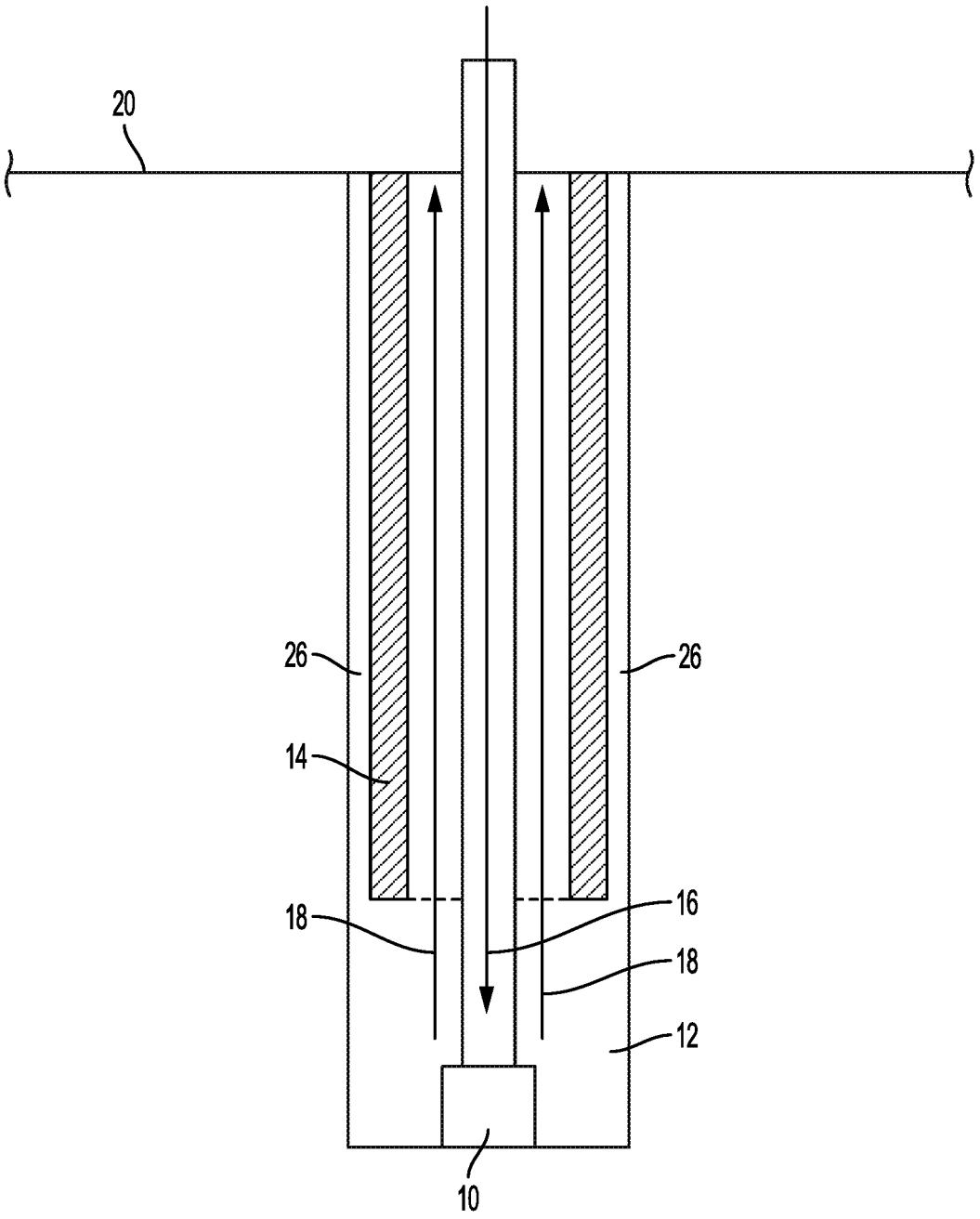
FIG. 1 is a cross-section of an example wellbore having normal circulation.

Referring to FIG. 1, to produce a well, a drill 10 bores through earth, rock, and other materials to form a wellbore 12. A casing 14 supports the sides of the wellbore. The drilling process includes, among other things, pumping drilling fluid 16 down into the wellbore, and receiving return fluid 18 containing materials from the wellbore at surface 20. In some implementations, the drilling fluid includes water- or oil-based mud and, in some implementations, the return fluid contains mud, rock, and other materials to be evacuated from the wellbore. This circulation of fluid into, and out of, the wellbore, may occur throughout the drilling process. In some cases, this circulation is interrupted, which can have an adverse impact on drilling operations. For example, loss of circulation can result in dry drilling, which can damage the drill bit, the drill string, or the drilling rig itself. In some cases, loss of circulation can cause a blow-out and result in loss of life.

Figure 2:
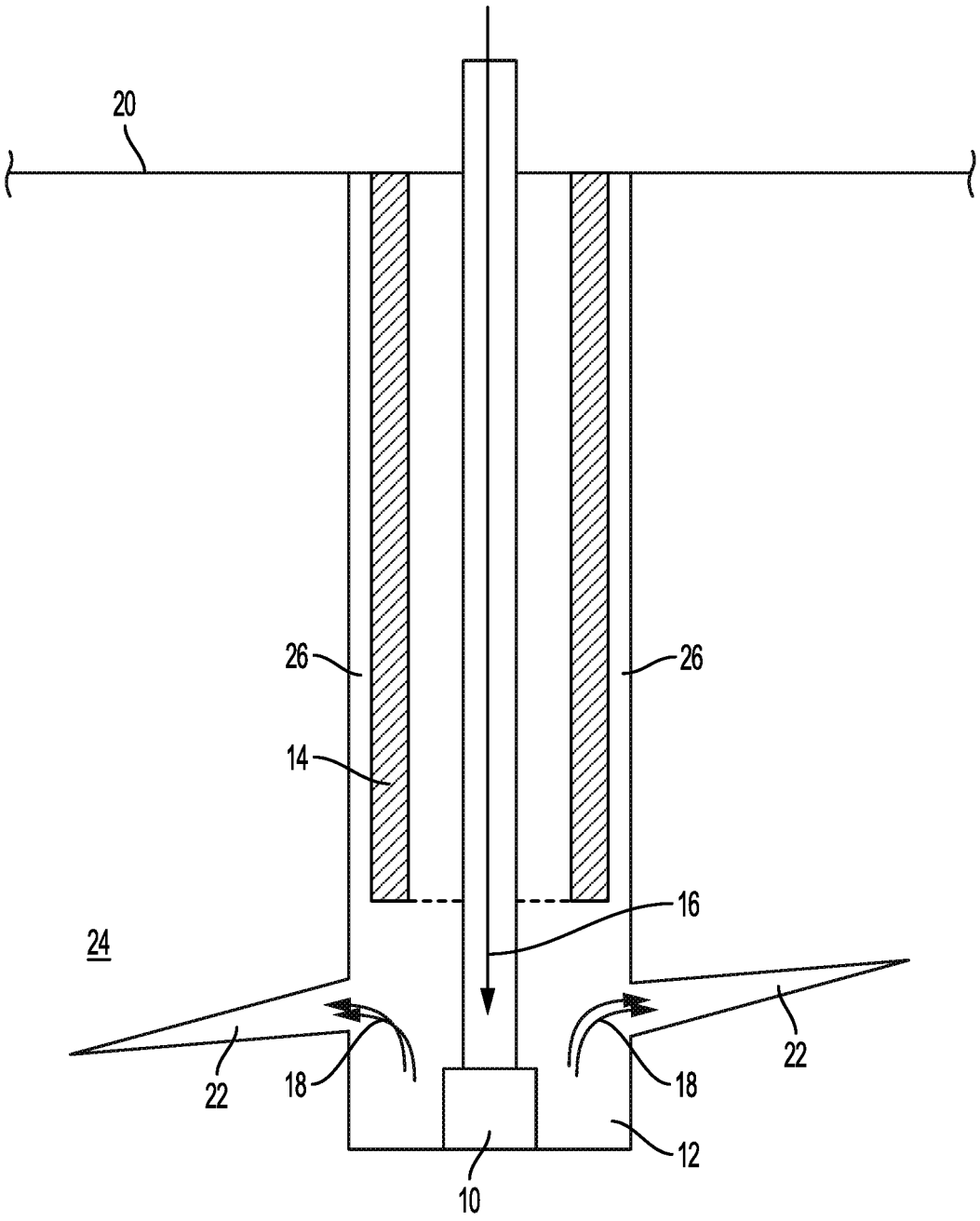
FIG. 2 is a cross-section of an example wellbore having lost circulation.

There are degrees of lost circulation that may be addressed. For example, a total loss of circulation occurs when no return fluid reaches the surface following introduction of drilling fluid into the wellbore. A total loss of circulation may result from faults, such as fractures, in a subterranean formation. For example, as shown in FIG. 2, the drilling fluid, the return fluid, or both may escape into fractures, such as fractures 22, in a surrounding formation 24, causing the loss of circulation. Depending upon the size of the fracture and the volume of fluids involved, the escaping fluids may cause a total loss in circulation or a partial loss in circulation. In this regard, a partial loss of circulation results in less return fluid than anticipated for a given amount of drilling fluid. A partial loss of circulation may also be caused by subterranean formations that are highly permeable, that have a less-than-normal hydrostatic pressure, or both. In some cases, drilling with total loss of circulation may result in hole collapse due lack of hydrostatic pressure supporting the wellbore. This can lead to drilling equipment being lost or stuck downhole.

In some implementations, a lost circulation zone may be identified based on the volume of return fluid removed from a wellbore. For example, the volume of return fluid may be measured using one or more detection mechanisms, and compared to an expected volume of return fluid for a given amount of drilling fluid pumped into the wellbore. If the amount of return fluid deviates by more than a threshold amount from the expected amount of return fluid for a given depth in a wellbore, a lost circulation zone is detected. In some implementations, computer programs may be used to process information about the volumes of drilling fluid and return fluid, and to make a determination about whether a lost circulation zone has been encountered. In some implementations, this determination may be made in real-time (such as during drilling) so that the situation can be remedied before damage occurs. In some implementations, the computer programs may be used to alert drilling engineers about a detected lost circulation zone, to begin automatic remedies, or both. In some implementations, a lost circulation zone may be detected using other methods based on the quantity or quality of the return fluid.

In some implementations, lost circulation zones may affect cementing operations. In this regard, drilling cuts through rock formations to form a wellbore that reaches a subterranean reservoir. The sides of the wellbore, however, typically require support. A casing is inserted into the wellbore and is used for supporting the sides of the wellbore, among other things. In some implementations, the casing—also called a setting pipe—may be a metal tubing that is inserted into the wellbore in sections. A space between the casing and the untreated sides of the wellbore may be cemented to hold the casing in place.

During normal cementing operations—for example, cementing operations solely to support a casing in a wellbore—cement slurry is pumped into the wellbore and allowed to set to hold the casing in place. Referring to FIG. 1, the cement slurry occupies space 26 between the wellbore and the casing, and hardens there to form cement. After the cement has hardened at least a threshold amount, the bottom of the well is drilled, and the process for completing the well proceeds. In lost circulation zones, such as those involving fractures, the cement slurry can also escape into the fracture, can mix with formation fluid in the fracture, or both. This can prevent the cement from hardening, and thus supporting the casing. Accordingly, a lost circulation zone may also affect cementing operations.

Figure 3:
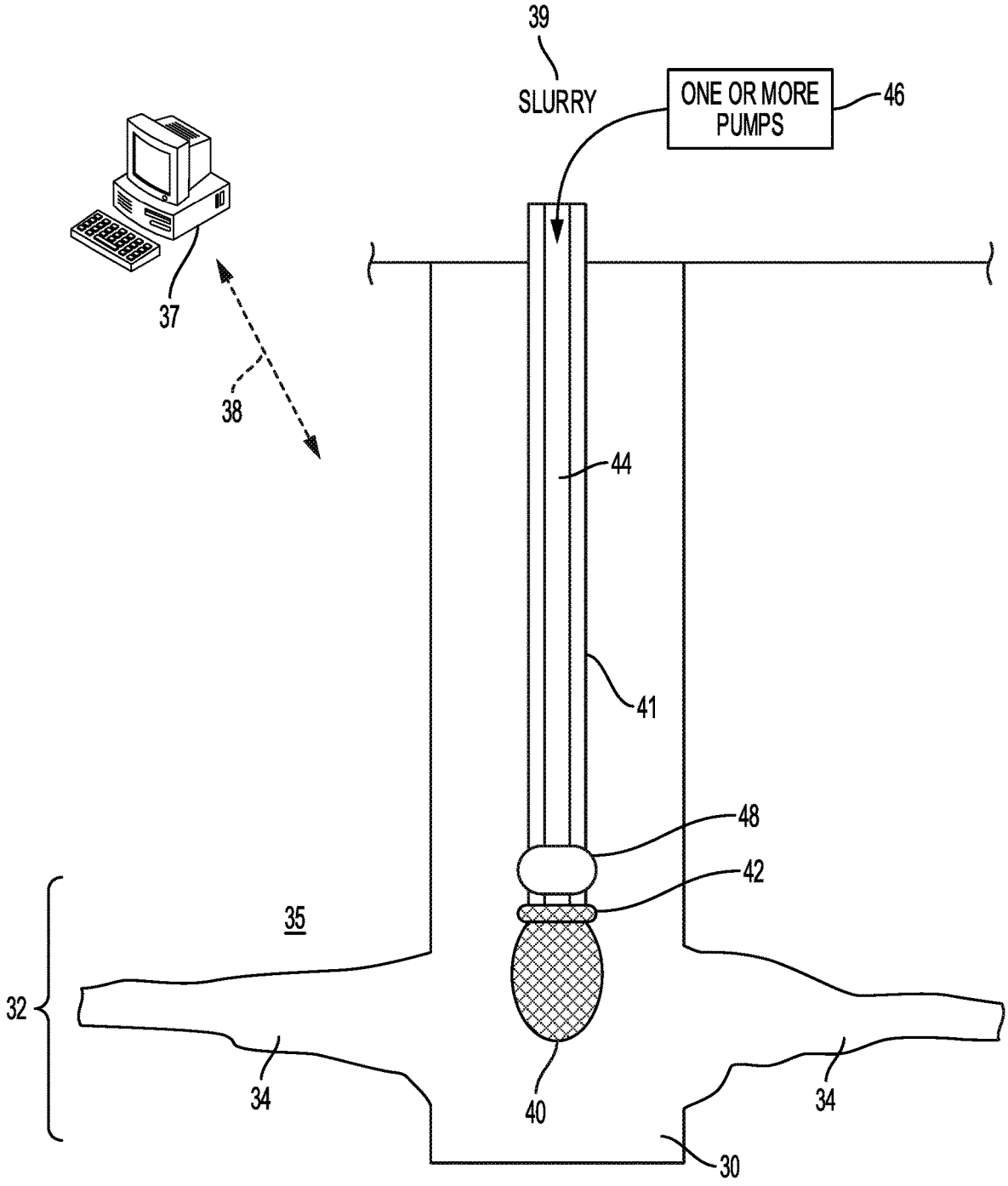
FIG. 3 is a cross-section of an example wellbore containing an inflatable that has not yet expanded within the lost circulation zone.

FIG. 3 shows an example wellbore 30 having a lost circulation zone 32. No casing is depicted in FIG. 3 or associated FIG. 4. In this example, lost circulation zone 32 is a result of fractures 34 contained in surrounding rock formation 35. A computer system, such as computer system 37, may be programmed to identify the lost circulation zone based on previously-determined maps of the formation or based on information 38 (depicted as a dashed line) obtained from one or more sensors (not shown) inside, or associated with, wellbore 30. The computer system may be programmed also to determine, to control, or both to determine and to control the amount of slurry 39 to inject into the wellbore, and the times at which the slurry should be injected to cure the lost circulation zone.

In this regard, to cure lost circulation zone 32, an inflatable 40 is lowered into wellbore 30 to a vicinity of the lost circulation zone. Inflatable 40 may be a balloon or other appropriate expandable device. In some examples, a balloon that is thirty (30) feet (ft) in diameter is used; however, the system is not limited to a balloon having this or any other specific dimension. The inflatable may be lowered to a depth that is uphole of the lost circulation zone or to a depth that is within, or adjacent to, the lost circulation zone. In some implementations, the inflatable is lowered into the wellbore using a conduit 41. Examples of conduits that may be used for this purpose include, but are not limited to, a drill pipe and a fiberglass pipe.

Conduit 41 contains an internal channel 44 and a joint 42. Inflatable 40 is connected to joint 42. When positioning conduit 41 downhole, joint 42 is positioned in the vicinity of the lost circulation zone, thereby moving the inflatable into an appropriate position relative to the lost circulation zone. Inflatable 40 includes a receptacle configured to receive material, such as slurry, into the inflatable. This receptacle is physically connected to the joint 42 and in alignment with the internal channel. By way of this connection, slurry 39 can be forced through conduit 41 and into inflatable 40. In some implementations, the slurry may be pumped into the receptacle using one or more pumps 46 that are located on the wellhead or at another appropriate location on the surface or downhole. The pumps may be controlled, for example, by the computer system or manually, to pump the slurry into the inflatable until the inflatable reaches a predefined expansion without breaking.

The size of the inflatable, and therefore the amount of expansion the inflatable can tolerate, may be based on the subterranean geography of the lost circulation zone. For example, a lost circulation zone having large fractures may require a larger inflatable than a lost circulation zone having smaller fractures. The geography of the lost circulation zone may be mapped prior to inserting the inflatable into the lost circulation zone. The size, composition, and other attributes of the inflatable may be selected based on downhole features, such as the depth of the lost circulation zone, the sizes and numbers of fractures contained in the lost circulation zone, and the diameter of the wellbore. The size, composition, and other attributes of the inflatable may also be selected based on downhole environmental conditions, such as temperature and pressure.

Figure 4:
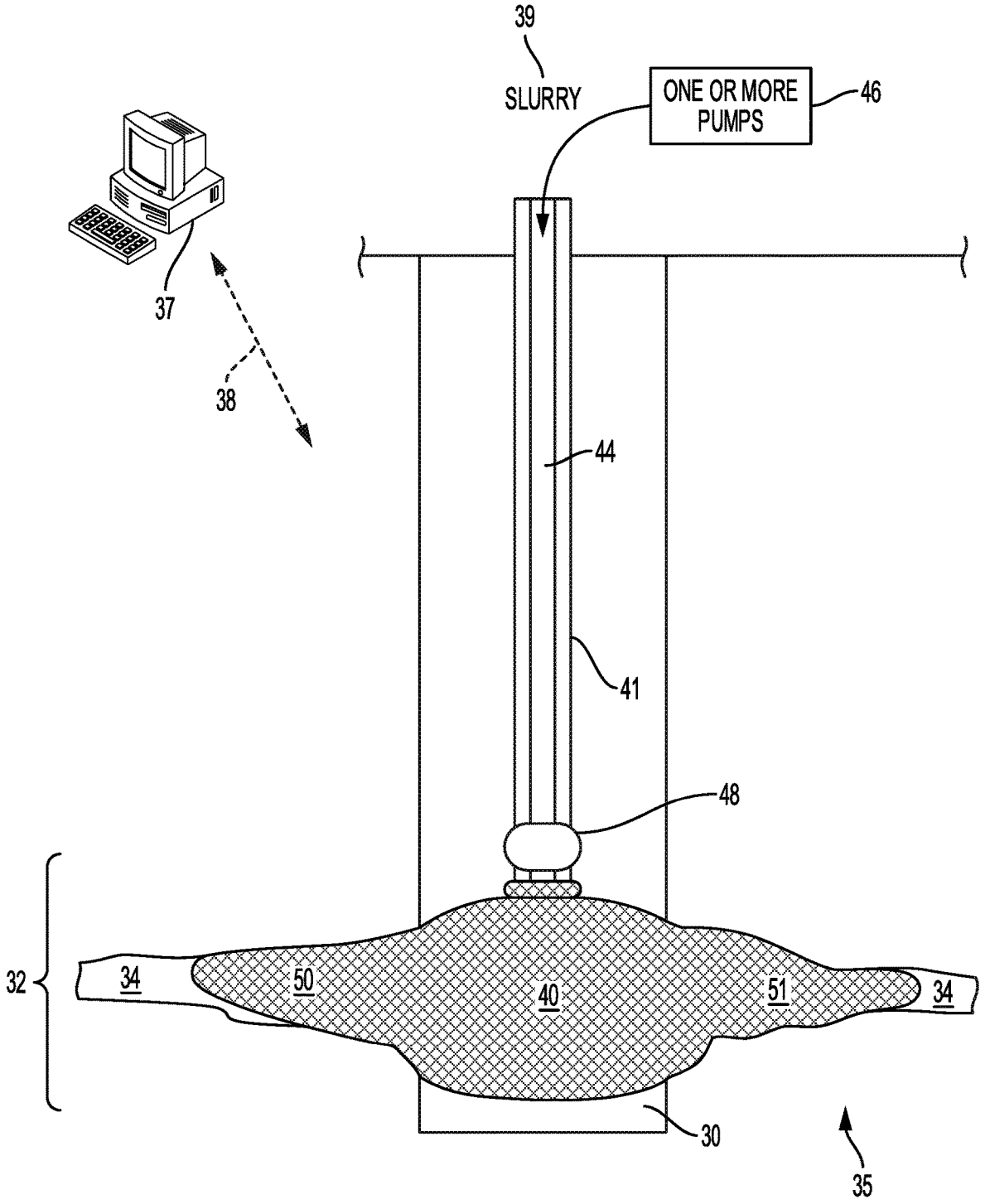
FIG. 4 is a cross-section of an example wellbore containing an inflatable that has expanded into fractures within the lost circulation zone.

Referring also to FIG. 4, as slurry 39 is forced into inflatable 40, inflatable 40 expands within wellbore 30. Expansion occurs such that parts 50 and 51 of inflatable 40 containing slurry expand into fractures 34. The amount of slurry to be pumped to achieve expansion to fill at least part of the fractures may be based on prior mapping of the subsurface geography of the lost circulation zone. Following expansion of the inflatable, conduit 41 may be withdrawn from wellbore 30. In some implementations, conduit 41 may be withdrawn immediately following expansion. In some implementations, conduit 41 may be withdrawn after a predetermined time following expansion. For example, the conduit may be withdrawn after the slurry in the inflatable has set to reach at least a predefined thickness or hardness.

The slurry in the inflatable, including the parts of the inflatable in the fractures, is set for a period of time to produce a solid in the fracture that can isolate the fracture from drilling fluid in the wellbore. As a result, the drilling fluid cannot escape into the fractures. Furthermore, the fractures may contain formation fluids, such as water or hydrocarbons. The solid within fractures confines the formation fluids within the fractures. As a result, the formation fluids do not mingle with drilling fluid or with cement slurry that may be introduced into the wellbore.

Thus, after a sufficient amount of time passes, the slurry sets to produce a solid within the wellbore and the fractures. At this point, however, solid also remains in the wellbore itself. Accordingly, a drill is introduced into, or moved downhole in, the wellbore. The drill cuts through the solid and the inflatable inside the wellbore, but leaves the solid and parts of the inflatable in the fractures. As a result, at least part of each fracture is filled with solid. As noted, drilling fluid cannot then escape into the fractures, and formation fluid cannot seep into the wellbore. The drill may then continue drilling to lower depths to complete the well.

In some implementations, a circulating sub 48 may be positioned uphole of joint 42. The circulating sub may be configured to displace drilling fluid prior to, or during, forcing the slurry into the inflatable. For example, the wellbore may contain drilling fluid prior to expansion of the inflatable. The circulating sub may be operated to remove that drilling fluid. The circulating sub may continue its operation while the slurry is pumped into the inflatable. In some implementations, the circulating sub is configured to discontinue operation in response to the slurry reaching a circulating valve in the circulating sub. For example, at that point, the inflatable may be expanded a desired amount, such as in FIG. 4. The operation of the circulating sub may be discontinued to allow the slurry in the inflatable to set. In some implementations, additional slurry may be pumped into the inflatable even after the circulating sub has discontinued operation.

The slurry may be composed of any appropriate material that can harden under downhole temperature and pressure conditions. For example, in some implementations the slurry may be or include a cement slurry, and the resulting solid may be or include cement. In some implementations, the slurry may be or include gunk plug, and the resulting solid may be or include a substance formed from the gunk plug. In some implementations, the slurry may be or include a resin-based substance. Some slurries, such as cement slurry, may take about four to five hours to set; for example, to harden to a point where the slurry loses a threshold amount of its plasticity. However, the processes described in this specification are not limited to use with any specific slurries or to use with slurries having specific hardening times.

Figure 5:
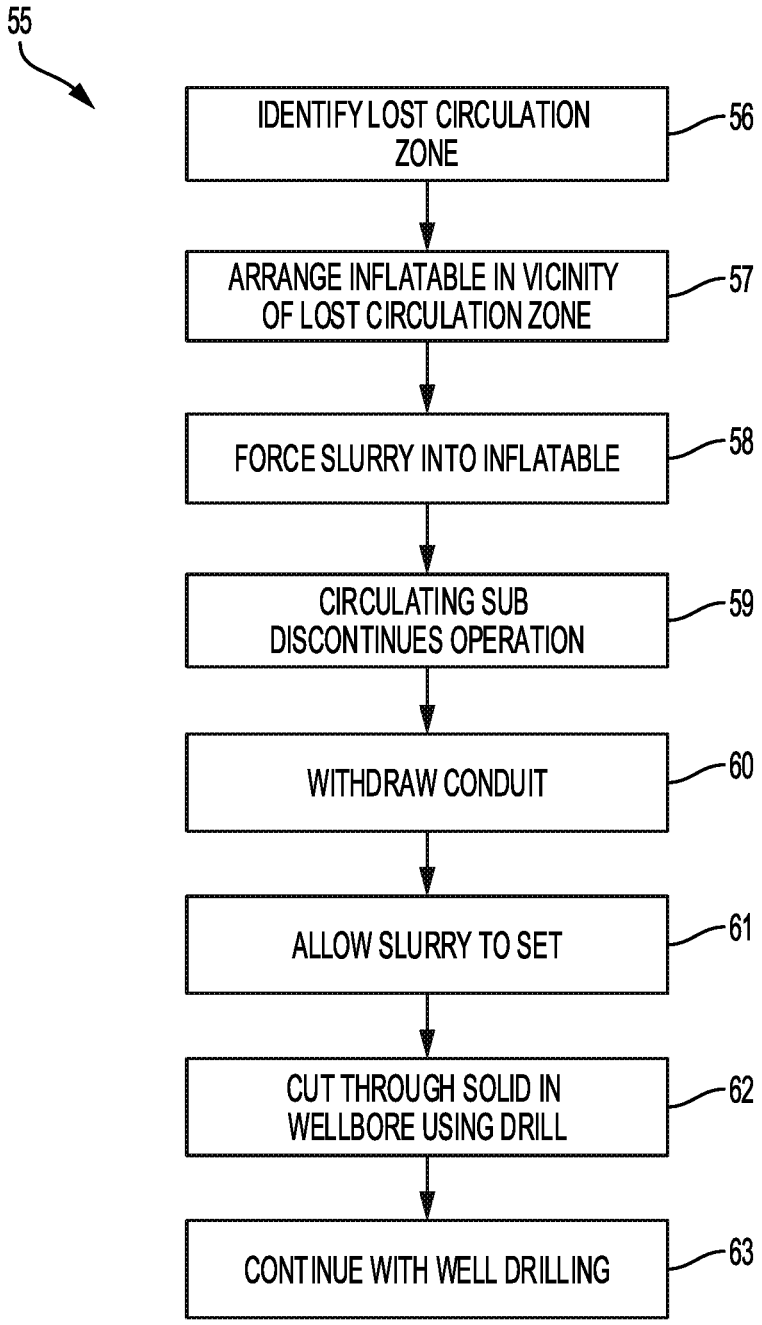
FIG. 5 is a flowchart showing an example process for curing a lost circulation zone in a wellbore using an inflatable.

The time needed for the slurry to set to produce a solid may vary based on a number of conditions including, but not limited to, the composition of the slurry, the temperature in the wellbore, and the pressure in the wellbore. In some implementations, the solid may have a hardness that is less than a complete hardness of cement. In some implementations, the solid may have a hardness that is at least as hard as a complete hardness of cement Referring to FIG. 5, a process 55 is shown for curing a lost circulation zone using the equipment described previously. Process 60 includes identifying (56) a lost circulation zone. Techniques for identifying the lost circulation zone are described previously. An example lost circulation zone 32 in a wellbore 30 is shown in FIGS. 3 and 4. Process 60 includes arranging (57) an inflatable in a vicinity of the lost circulation zone. This may be done, for example, by mounting the inflatable to conduit 41, and lowering the conduit and the inflatable to the depth of the lost circulation zone. In an example, the conduit may be part of a bottom hole assembly (BHA) that is run downhole to, or near to, the lost circulation zone. At this time, a circulating sub located on the conduit above the inflatable may begin or continue its operation to pump drilling fluid and other materials from the wellbore to the surface. In some implementations, operation of the circulating sub may continue until slurry reaches an on/off valve in the circulating sub.

To expand the inflatable, slurry is forced (58) into the inflatable to cause at least part of the inflatable containing the slurry to expand into one or more fractures within the lost circulation zone. As explained, the slurry may be pumped through the conduit and into the inflatable using one or more pumps located on the wellhead or elsewhere. After the slurry reaches an on/off valve of the circulating sub, the circulating sub discontinues (59) operation. In some implementations, pumping of slurry may continue following deactivation of the circulating sub; for example, if the inflatable has not yet reached the desired amount of expansion.

After the inflatable has reached the desired amount of expansion, the conduit may be withdrawn (60) from the wellbore. In this regard, a set amount of slurry may be defined beforehand to achieve the desired expansion of the inflatable. Once all of this slurry has been pumped into the inflatable, it may be inferred that the inflatable has reached the desired amount of expansion. At this point, in this example, the slurry, which is encased in the inflatable, occupies both the fractures in the lost circulation zone and the wellbore through the lost circulation zone.

Process 55 includes allowing (61) the slurry to set to at least a threshold hardness to produce a solid. For example, the slurry may be allowed to harden completely to produce a solid material, such as cement. After the slurry has set to produce a solid, a drill is run downhole to cut (62) through the solid and the inflatable in the wellbore, leaving the solid within the fractures of the lost circulation zone. Drilling includes introducing drilling fluid into the wellbore, and removing the fluid, mud, and debris as the drill cuts to further depths. The solid in the factures seals the lost circulation zone, allowing drilling to continue. That is, curing the lost circulation zone restores circulation to the well, allowing return fluid, including mud and other materials, to reach the surface following pumping of drilling fluid into the wellbore. Drilling (63) may continue as normal to depths below the lost circulation zone.

Although vertical wellbores are show in the examples presented in this specification, the processes described previously may be implemented in wellbores that are, in whole or part, non-vertical. For example, the processes may be performed for a fracture that occurs in a horizontal, or partially horizontal, wellbore. Where horizontal is measured relative to the Earth's surface in some examples.

All or part of the processes described in this specification and their various modifications (subsequently referred to as "the processes") may be controlled at least in part, by one or more computers using one or more computer programs tangibly embodied in one or more information carriers, such as in one or more non-transitory machine-readable storage media. A computer program can be written in any form of programming language, including compiled or interpreted languages, and it can be deployed in any form, including as a stand-alone program or as a module, part, subroutine, or other unit suitable for use in a computing environment. A computer program can be deployed to be executed on one computer or on multiple computers at one site or distributed across multiple sites and interconnected by a network.

Actions associated with controlling the processes can be performed by one or more programmable processors executing one or more computer programs to control all or some of the well formation operations described previously. All or part of the processes can be controlled by special purpose logic circuitry, such as, an FPGA (field programmable gate array), an ASIC (application-specific integrated circuit), or both an FPGA and an ASIC.

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the processes described without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A method of forming a well, comprising:

identifying a lost circulation zone in a wellbore, the lost circulation zone comprising a fracture in a formation adjacent to the wellbore, the wellbore comprising a conduit comprising a joint that is in a vicinity of the lost circulation zone;

arranging an inflatable in the vicinity of the lost circulation zone by mounting the inflatable to the joint;

arranging a circulating sub uphole of the joint, the circulating sub operating to displace drilling fluid prior to forcing the slurry into the inflatable;

forcing slurry into the inflatable to cause at least part of the inflatable containing the slurry to expand into the fracture;

discontinuing operation of the circulating sub based on the slurry reaching a circulating valve in the circulating sub;

allowing the slurry to set for a period of time to produce a solid;

removing the conduit from the wellbore prior to drilling; and drilling through the solid in the inflatable in the wellbore, leaving the solid in the fracture.

2. The method of claim 1, where drilling comprises:

introducing drilling fluid into the wellbore;

where the slurry in the fracture is set for a period of time to produce the solid in the fracture that isolates the fracture from the drilling fluid.

3. The method of claim 1, where forcing the slurry into the inflatable comprises using one or more pumps to pump the slurry into the inflatable until the inflatable reaches a predefined expansion without breaking.

4. The method of claim 1, where the slurry comprises cement slurry, and where the solid comprises cement.

5. The method of claim 1, where the slurry comprises gunk plug, and where the solid comprises a substance formed from the gunk plug.

6. The method of claim 1, where the slurry comprises a resin-based sub stance.

7. The method of claim 1, where the inflatable comprises a balloon.

8. The method of claim 1, where the conduit comprises a drill pipe.

9. The method of claim 1, where the conduit comprises fiberglass.

10. The method of claim 1, where the fracture contains formation fluid;

where the part of the inflatable enters the formation and forces at least part of the formation fluid from a region adjacent to the wellbore; and where, following setting, the inflatable confines the formation fluid within the fracture.

* * * * *